United States Patent [19]

Hauk

[11] Patent Number: 5,060,542

[45] Date of Patent: Oct. 29, 1991

[54] APPARATUS AND METHOD FOR MAKING AND BREAKING JOINTS IN DRILL PIPE STRINGS

[75] Inventor: Thomas D. Hauk, Los Alamitos, Calif.

[73] Assignee: Hawk Industries, Inc., Long Beach, Calif.

[21] Appl. No.: 596,774

[22] Filed: Oct. 12, 1990

[51] Int. Cl.[5] ..... E21B 19/16

[52] U.S. Cl. ..... 81/57.34; 81/57.16; 81/57.21; 81/57.36

[58] Field of Search ..... 81/52, 54, 57.16, 57.21, 81/57.33, 57.34, 57.36, 105, 165, 179

[56] References Cited

U.S. PATENT DOCUMENTS

| | | | |
|---|---|---|---|
| 443,312 | 12/1890 | Bode | 81/52 |
| 1,186,668 | 6/1916 | Lemon | 81/57.16 |
| 1,259,670 | 3/1918 | Richard | 81/57.32 |
| 1,629,895 | 5/1927 | Tully | 81/57.32 |
| 1,676,507 | 7/1928 | Spanovic | 81/105 |
| 1,777,084 | 9/1930 | Heer | 81/57.32 |
| 1,806,481 | 5/1931 | Martois | 81/57.16 |
| 2,302,998 | 11/1942 | Martin | 81/57.34 |
| 2,450,967 | 10/1948 | Keiser | 81/57.32 |
| 2,453,369 | 11/1948 | Grable et al. | 81/57.34 |
| 2,454,317 | 11/1948 | Hambly | 81/57.34 |
| 2,528,814 | 11/1950 | Boyer | 81/100 |
| 2,540,553 | 2/1951 | Shobe | 81/57.32 |
| 2,633,045 | 3/1953 | Lurie | 81/179 |
| 2,668,689 | 2/1954 | Cormany | 81/57.16 |
| 2,705,614 | 4/1955 | McKibben et al. | 81/57.16 |
| 2,760,392 | 8/1950 | Paget | 81/57.16 |
| 2,787,181 | 4/1957 | Montgomery | 81/179 |
| 2,871,743 | 2/1959 | Kelley | 81/57.34 |
| 2,967,446 | 1/1961 | Martois | 81/57.16 |
| 3,025,733 | 3/1962 | Soodnizin | 81/57.16 |
| 3,041,901 | 7/1962 | Knights | 81/57.34 |
| 3,086,413 | 4/1963 | Mason | 81/57.16 |
| 3,122,952 | 3/1964 | Eliason | 81/57.34 X |
| 3,246,547 | 4/1966 | O'Neill et al. | 81/57.34 |
| 3,500,708 | 3/1970 | Wilson | 81/57.34 |
| 3,518,903 | 7/1970 | Ham et al. | 81/57.16 |
| 3,545,313 | 12/1970 | Kelley | 81/57.34 |
| 3,629,927 | 12/1971 | Palmer et al. | 29/240 |
| 3,799,009 | 3/1974 | Guier | 81/57.16 |
| 3,805,644 | 4/1974 | Porter | 81/57.2 |
| 3,838,613 | 10/1974 | Wilms | 81/57.34 |
| 3,880,024 | 4/1975 | Asada | 81/57.34 |
| 3,881,375 | 5/1975 | Kelly | 81/57.35 |
| 3,902,385 | 9/1975 | Haby | 81/57.34 |
| 3,921,473 | 11/1975 | Boyadjieff et al. | 81/57.34 |
| 4,005,621 | 2/1977 | Turner, Jr. et al. | 81/57.2 |
| 4,082,017 | 4/1978 | Eckel | 81/57.16 |
| 4,084,429 | 4/1978 | Boland | 73/139 |
| 4,092,881 | 6/1978 | Jürgens et al. | 81/57.34 |
| 4,128,135 | 12/1978 | Mitchhart et al. | 175/52 |
| 4,246,809 | 1/1981 | Keast et al. | 81/57.16 |
| 4,423,648 | 1/1984 | Toelke | 81/57.34 |
| 4,437,363 | 3/1984 | Haynes | 81/57.18 |
| 4,497,224 | 2/1985 | Jürgens | 81/57.34 |
| 4,545,269 | 10/1985 | Lemaire et al. | 81/57.34 |
| 4,574,664 | 3/1986 | Curry | 81/57.34 |

*Primary Examiner*—James G. Smith

*Attorney, Agent, or Firm*—Poms, Smith, Lande & Rose

[57] ABSTRACT

A power apparatus and method for making and breaking joints in drill pipe strings in oil wells, in which a single torquing cylinder, that always moves in a single direction while torquing, both makes and breaks the joints. Three levels of jaw elements are employed, the top and bottom jaw levels being identical to each other, all jaw elements being interconnected as by a frame. Other cylinders close the jaws at each level. The apparatus is moved vertically; two levels of jaw elements are employed for making and another combination of two levels is employed for breaking. Special die and cam means are provided to grip the drill pipe. Means are provided to position the jaws in the middle level at the proper location after each use, for different sizes of pipe. Special bearing, pivot and adjustment means are provided in the jaw elements. The jaw elements operate in only one direction, and are self energizing.

55 Claims, 8 Drawing Sheets

APPARATUS AND METHOD FOR MAKING AND BREAKING JOINTS IN DRILL PIPE STRINGS

BACKGROUND OF THE INVENTION

For making and breaking joints in strings of drill pipe in an oil well, etc., it is still common to employ manually-operated rig tongs, which are large and bulky and difficult to operate and which cannot easily provide controlled torque values. Such rig tongs are dangerous to use, being normally operated by a cable and winch. They are raised and lowered by hand.

Where hydraulic tongs have been employed in making and breaking joints in drill pipe strings, they have been excessively heavy, bulky, complex, expensive, or otherwise unsatisfactory in various regards.

SUMMARY OF THE INVENTION

Three levels of jaws are provided, the jaws in each level being of a type that energize when turned in a predetermined direction so as to have a stronger grip on the pipe when turned in such direction. The jaws in two levels are oriented so as to turn the pipe in one direction, while the jaws on the remaining level are oriented to turn the pipe in the opposite direction. The jaws in the three levels are associated with each other as by a common frame.

Fluid-operated means are provided to close the jaws prior to commencement of torquing, so that subsequent torquing will operate effectively to increase the amount of gripping and without sliding of the jaws off the joints in the string of drill pipe. Other fluid-operated means, connected to the frame, are provided to effect the torquing. In the preferred embodiment, the last-mentioned fluid-operated means is a single hydraulic cylinder that operates in the same direction for both making and breaking of a joint.

The apparatus is self-contained, and is preferably suspended rotatably at a wellhead.

Combination die and cam means are provided, and operate automatically in response to positioning of the apparatus on a drill pipe string, and to removal of the apparatus from such string. The die portions are so shaped and pivotally mounted as to properly grip the tool joint in response to both initial die closing and subsequent die energization, the latter being the result of torquing.

Means are provided to adapt the apparatus for operation relative to tool joints having a variety of diameters. Such means includes not only adjustable stops, but also means correlated with the stops to determine the position of the jaws, at one of the levels thereof, at the beginning of each operation. Bearing, pivot and adjustment means adapt each set of jaw for different joint diameters, without need for removing or replacing any parts.

In accordance with the method, three levels of jaws are provided, the jaws in each level being adapted to rotate a tool joint portion in only a single direction. The method is such that the apparatus is not turned over but is instead only raised and lowered so as to orient different combinations of jaws adjacent the tool joint. Then, the method is such that only two levels of jaws operate on the tool joint to make it or break it.

In a preferred embodiment of the method, making of a joint is effected by locking the middle jaws on the bottom portion of a tool joint, and employing the top and middle jaws to turn the top portion of the tool joint clockwise. Breaking of a joint is, in accordance with such preferred embodiment, effected by locking the bottom jaws on the bottom tool joint portion, and employing the middle and bottom levels of jaws to rotate the top portion of the tool joint counterclockwise.

DETAILED DESCRIPTION OF THE PREFERRED EMBODIMENT

For convenience, all uses of the words "clockwise" and "counterclockwise" in the present application mean as viewed from above.

Figure 1:
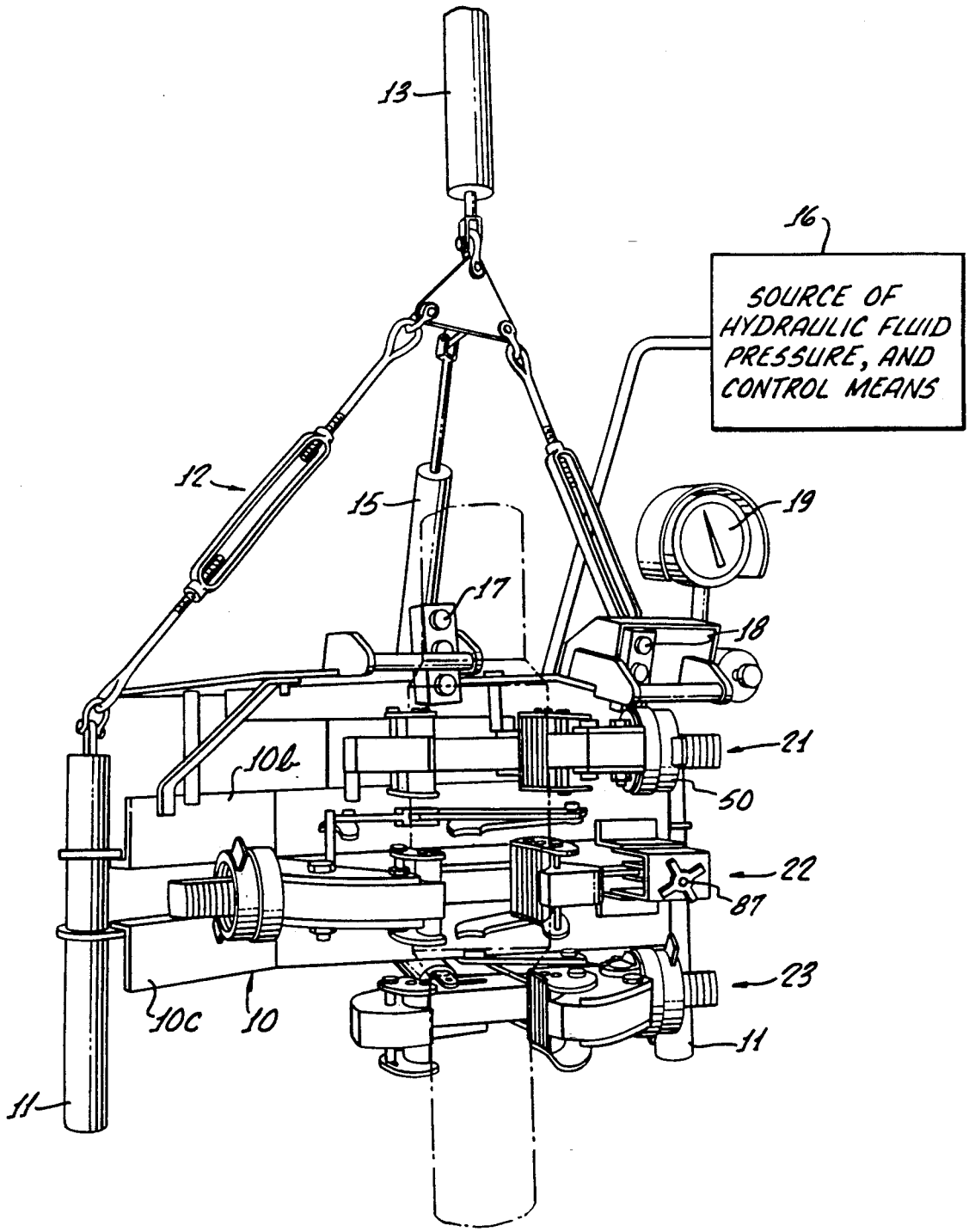
FIG. 1 is an isometric view of one side of the present apparatus.
Figure 2:
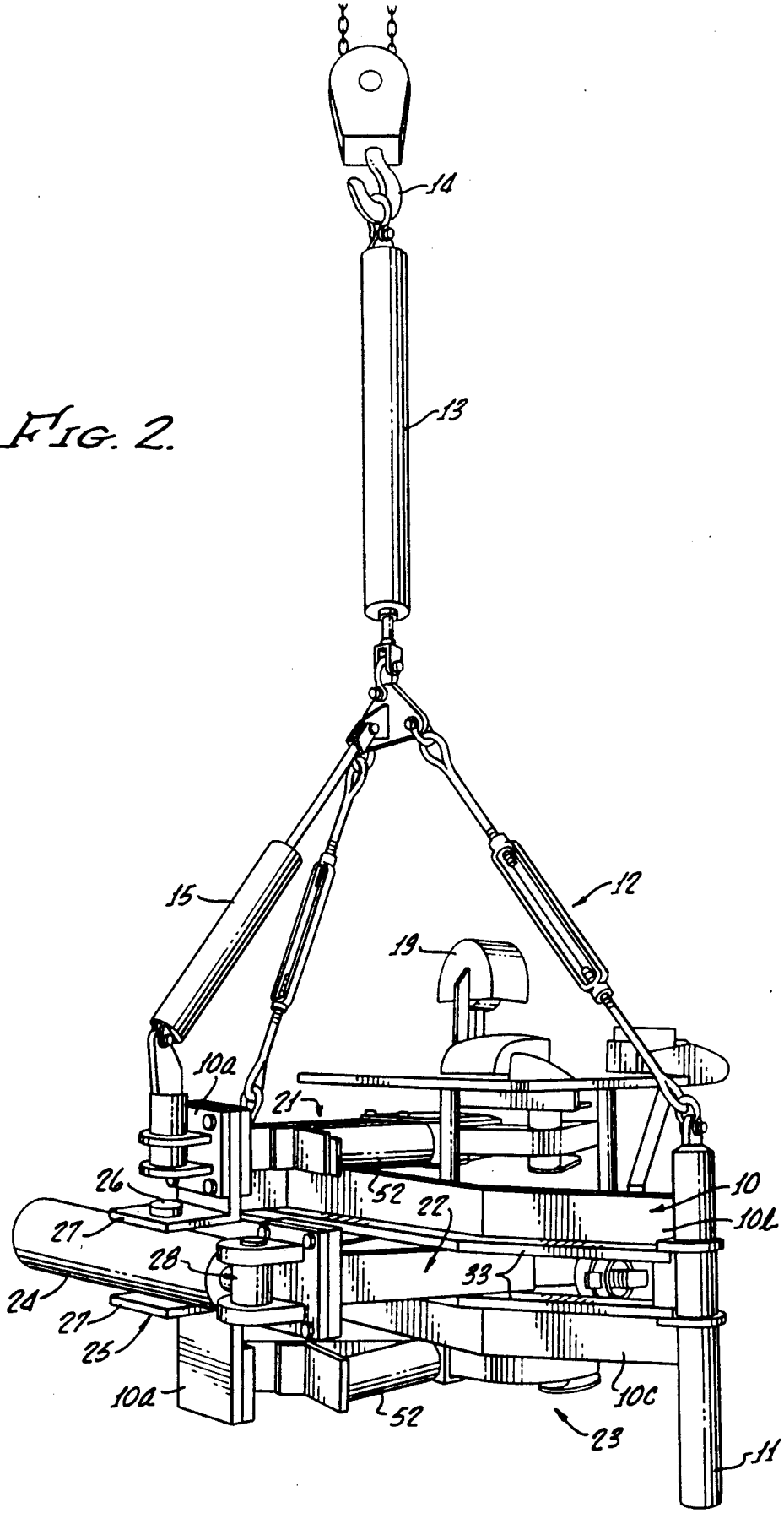
FIG. 2 is an isometric view of another side of the present apparatus.

Referring to FIGS. 1-7, inclusive, the apparatus is illustrated to comprise a strong welded frame 10 having legs 11, the latter being to support the apparatus when not in use. Normally and preferably, when the apparatus is in use it is suspended at the wellhead of an oil well. Suspension is effected by a three-element suspension means 12 that connects at its lower ends to suitable points on frame 10, and that connects at its upper end to an adjustment cylinder 13 carried by a cable-supported hook 14 (FIG. 2).

The suspension means 12 is normally so adjusted that the below-described jaw sets lie in horizontal planes, and at a height determined by the adjustment cylinder 13 (for a given positioning of the hook 14). Tilting of the apparatus may be effected by operation of a tilt cylinder 15 that forms one of the three elements of suspension means 12. The other two elements include turnbuckles for leveling purposes.

Preferably, the various cylinders 13, 15 and others are hydraulically operated. This is done by means of a source 16 of hydraulic fluid pressure, by various hydraulic lines (not shown), and by controls 17 and 18 (FIG. 1), the controls being associated with control elements that are included in element 16. A gauge 19 indicates the hydraulic fluid pressure.

Figure 3:
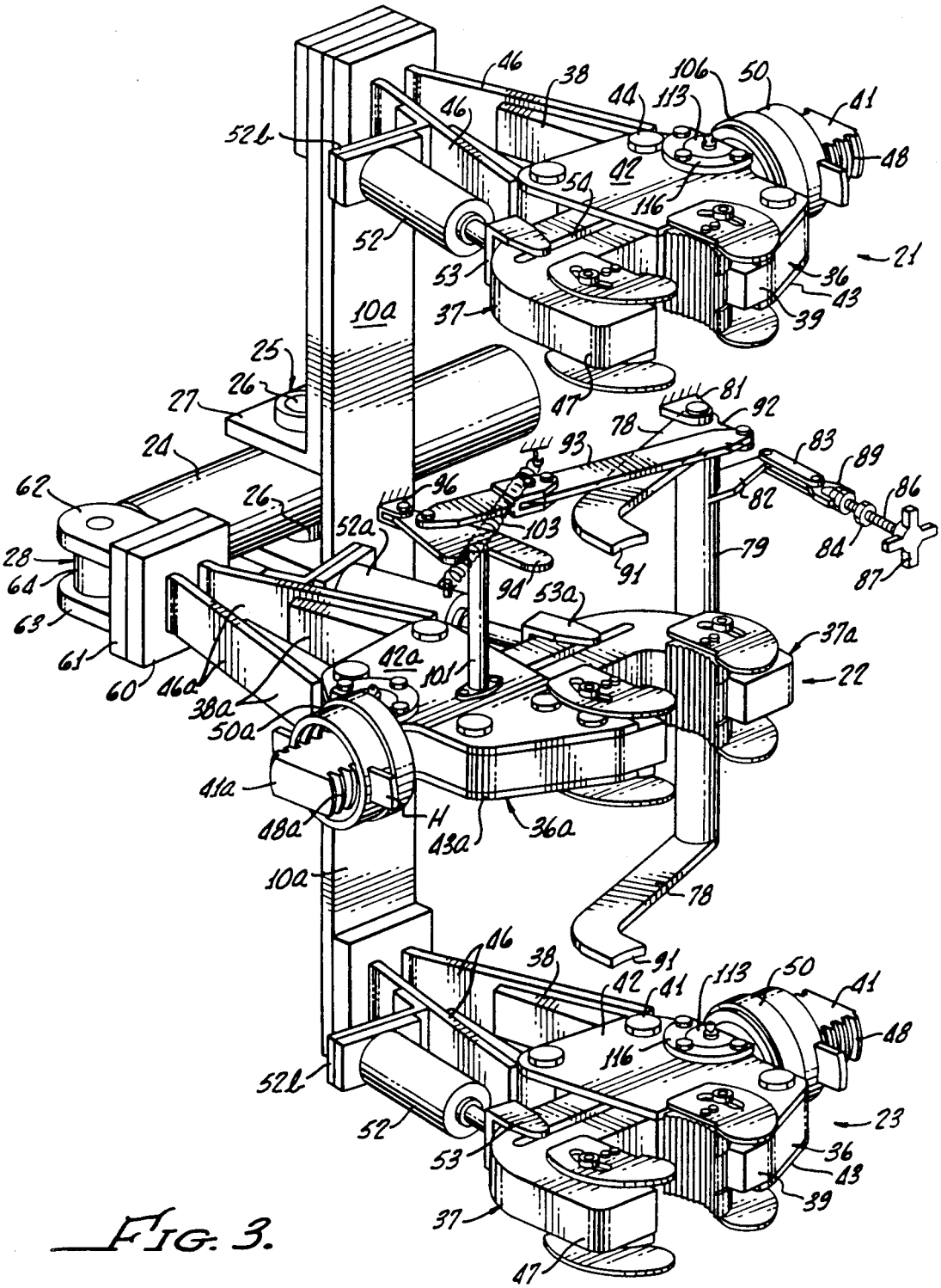
FIG. 3 is an isometric view illustrating the three levels of jaws, and associated cylinder and adjustment means, the jaws being shown in closed positions but the pipe being unshown for purposes of clarity.

Referring next to FIGS. 2 and 3, particularly the latter, a strong vertical portion of frame 10 is denoted 10*a*. Mounted in vertically-spaced relationship on frame portion 10*a* are three sets of jaws. The top set of jaws is numbered 21; the middle set is numbered 22; and the bottom set is numbered 23. In the preferred embodiment, the top and bottom jaws 21, 23 are identical to each other and are oriented identically to each other—the bottom set of jaws being directly below the top set of jaws. The top and bottom jaws being oriented identically, they are adapted to turn a tool joint portion in the same direction.

The middle set of jaws, number 22, is reverse oriented relative to the top and bottom sets, being adapted to turn the tool joint portion in the opposite direction. The middle set of jaws is in vertical alignment with the top and bottom sets, at the regions of the middle set that are adjacent the tool joint.

In the preferred embodiment, top and bottom jaw sets 21, 23 are fixedly secured to frame portion 10*a*. Conversely, middle jaw sets 20 is not fixedly associated with frame portion 10*a*, being instead pivotally related to such frame component so that the middle jaw set 22 may pivot horizontally relative to the frame. The axis of such pivotal motion is caused to be at the axis of rotation of the jaws 22, 23.

Figure 5:
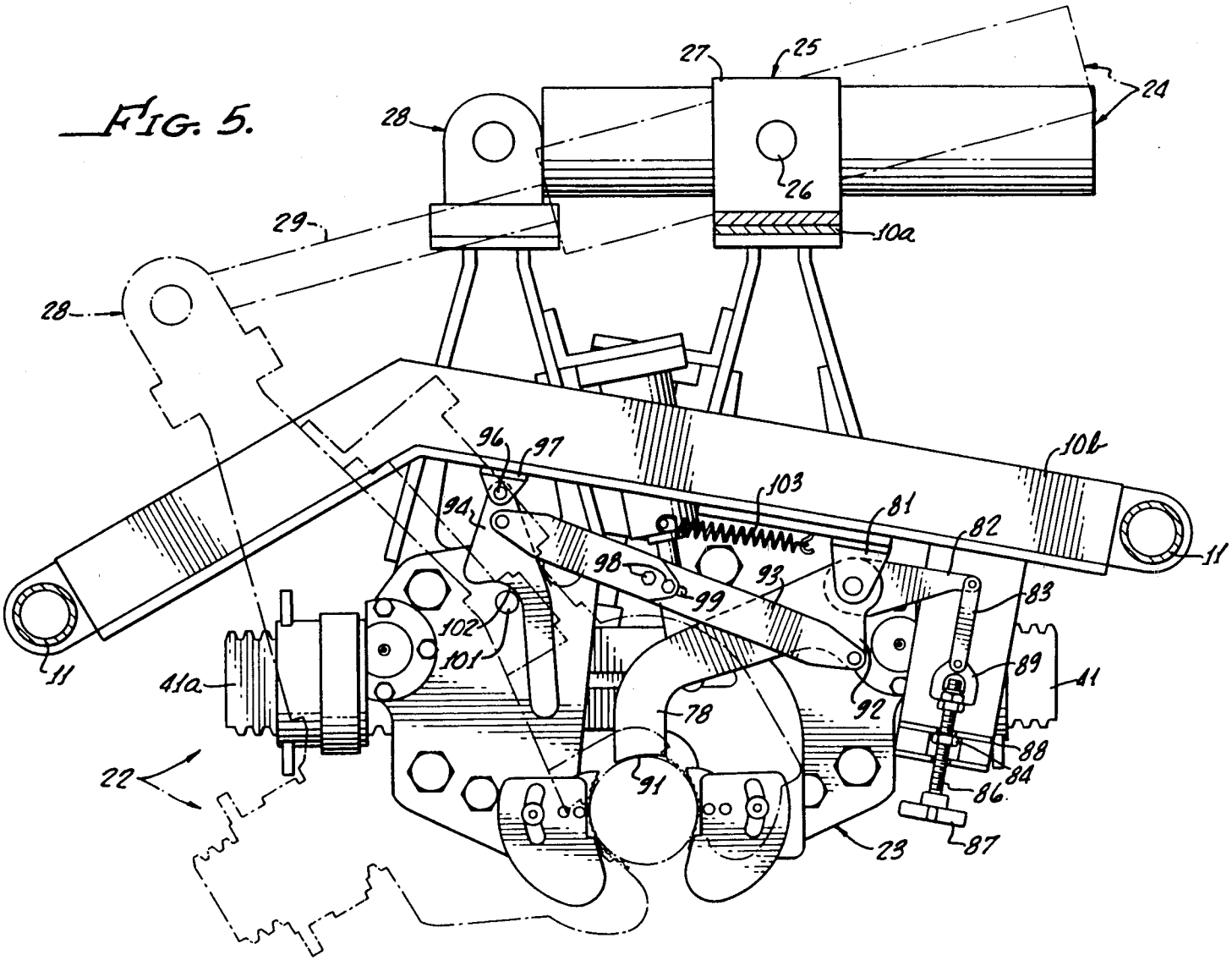
FIG. 5 is a view of the same general type as FIG. 4, but taken one level down from that of FIG. 4, namely at a region just above the central level. The parts are shown in solid lines in the positions they have prior to breaking of a joint; they are shown in phantom lines in the positions that they have after such breaking.

Also in the preferred embodiment, the pivotal mounting of the middle jaw set 22 on frame portion 10*a* is not direct but instead through a torquing cylinder 24. Stated more definitely, and referring to FIGS. 2 and 3, the cylinder (body) portion of torquing cylinder 24 is strongly pivotally associated with frame component 10*a* by pivot means shown at 25, the axis of such pivot means being vertical. The pivot means 25 comprises top and bottom pivot pins 26 that extend downwardly and upwardly through strong horizontal flange portions 27 of frame portion 10*a*. Such flange portions 27 are immediately above and below the cylindrical body of torquing cylinder 24. As shown in FIG. 5, the pins 26 are sufficiently far from the vertical elements of frame portion 10*a* that the torquing cylinder may pivot to substantial angles relative to such frame portion.

Figure 4:
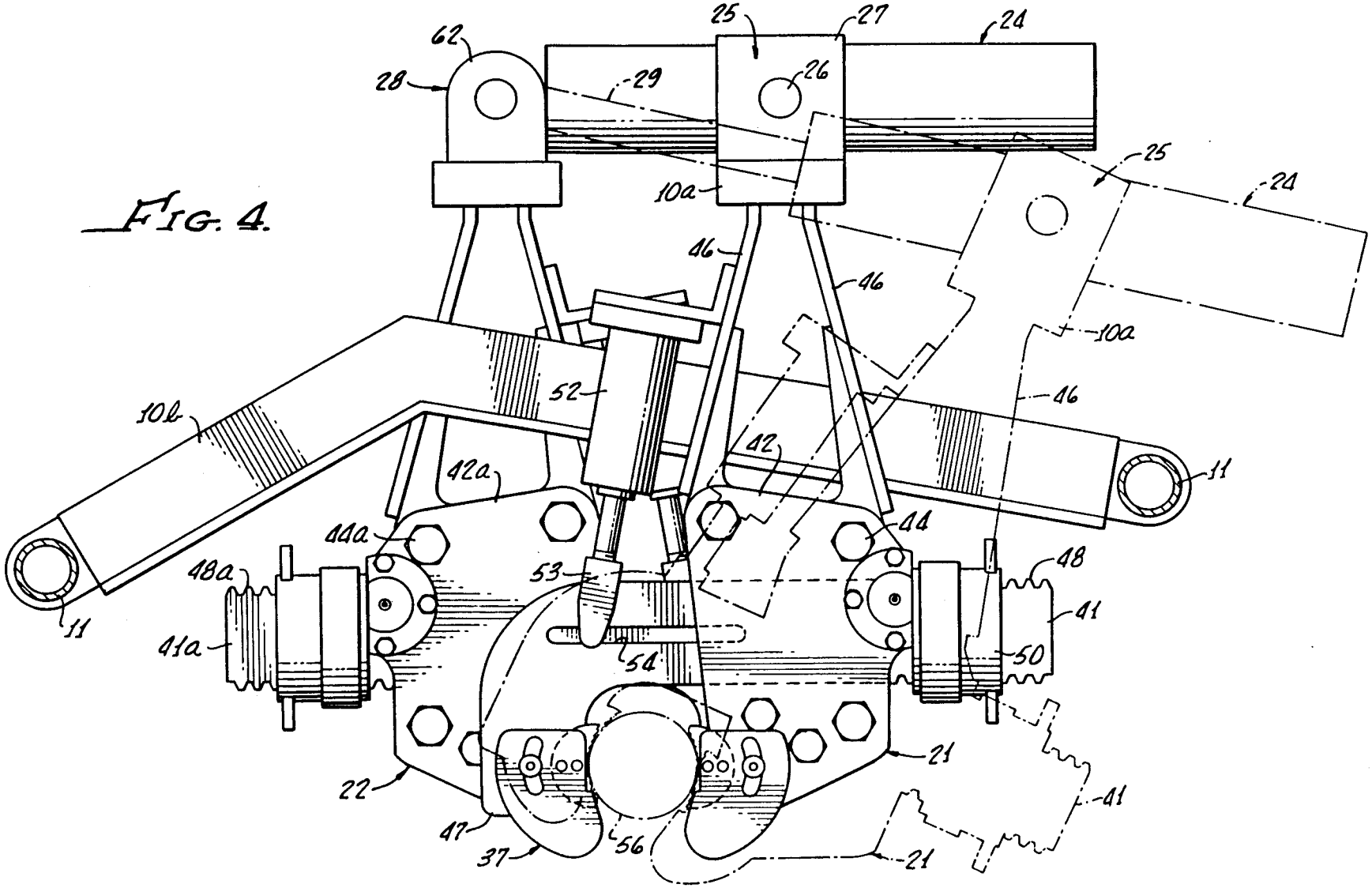
FIG. 4 shows major portions of the apparatus, as viewed from above the top level of jaws, showing in solid lines the positions of parts before making of the joint, and showing in phantom lines the position of parts after making of the joint.

A second strong pivot means 28 is provided, as shown in FIGS. 2 and 3, this being connected to the end of the piston rod 29 of torquing cylinder 24 (the rod being shown in phantom lines in FIGS. 4 and 5). To cooperate with torquing cylinder 24 in holding the middle jaw set 22 in a horizontal plane, the frame 10 includes upper and lower horizontal frame components 10*b*, 10*c* and which define a horizontal slot 33 as shown in FIG. 2. A region of the middle set 22 of jaws is disposed slidably in slot 33, sandwiched between upper and lower frame components 10*b*, 10*c*, so that the middle jaw set may move horizontally relative to the frame, while remaining in a plane parallel to those of the top and bottom jaw sets 21, 23.

There will next be described the top and bottom jaw sets 21, 23. Since (in the preferred embodiment) these jaw sets are identical to each other and are identically oriented, only the top set 21 will be described. The bottom set 23 is given the same reference numbers as those of the top set.

Top jaw set 21 (and thus the identical bottom jaw set 23) will first be described generally, as will the middle jaw set 22. Thereafter, the method will be generally described, following which additional major aspects of the jaw sets and method will be described.

The top jaw set 21 has a head 36 in which is pivotally mounted, for pivotal movement about a vertical axis, a hook 37. Head 36 is fixedly connected to the upper end of frame portion 10*a* (FIG. 3). The relationships are such that when the tool joint is initially gripped by the head 36 and hook 37, rotation of the head 36 in a clockwise direction will cause additional energization of the jaws 21 to thereby strongly and effectively grip the tool joint for torquing thereof.

Stated more definitely, and with particular reference to FIGS. 3, 7, 8 and 9, head 36 has strong plate elements 38 and 39 that are spaced apart so as to receive the shank 41 of hook 21 between them. Elements 38 and 39 are strongly secured to each other by top and bottom head plates 42, 43, these being held in position by bolts 44.

Figure 8:
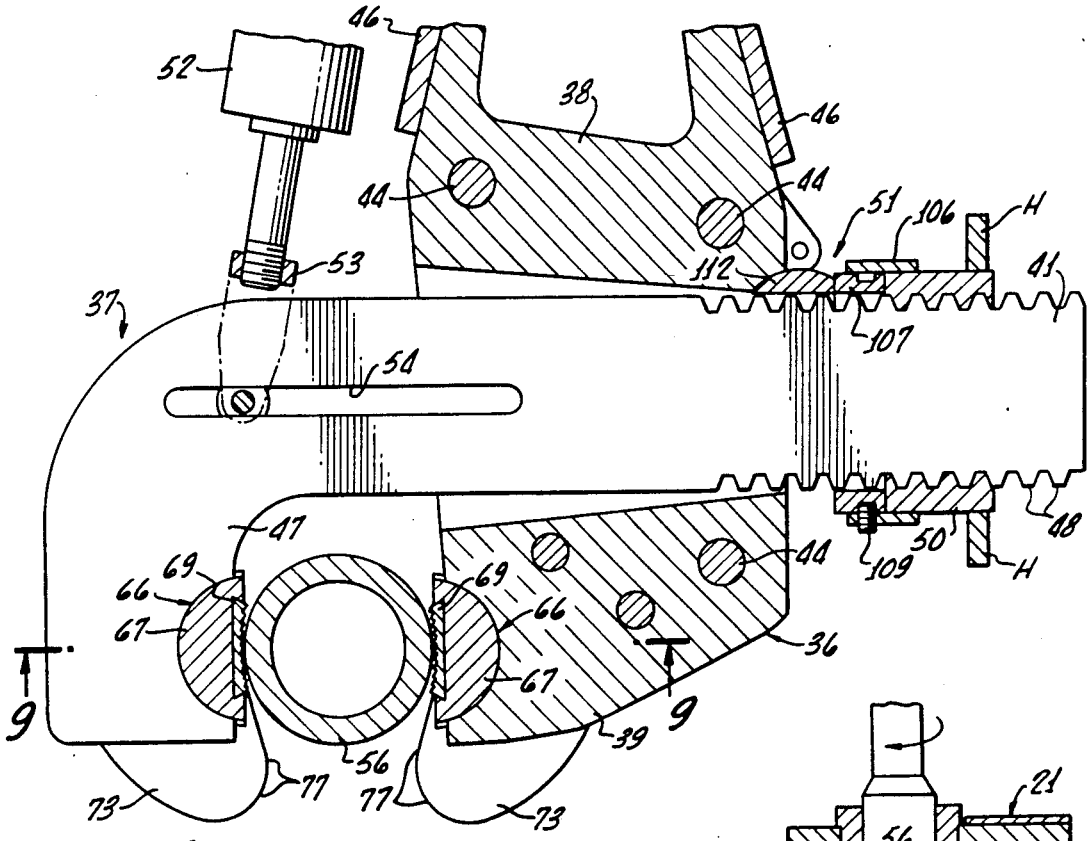
FIG. 8 is a view, partly in horizontal section, illustrating the components of one of the jaws, the jaws being shown closed on a tool joint.

Element 38 of the head is strongly connected by struts 46 to the upper end of frame portion 10*a* (FIGS. 3 and 8). These connections, and all others where bolts or screws are not described, are made by strong welds (not shown).

The shank 41 of hook 37 is flat on the top and bottom sides thereof, the upper and lower surfaces of the shank lying in horizontal planes (FIG. 3) and close to 42, 43. The sides of the shank 41, at the portion thereof remote from the hook end 47 (FIG. 8), are portions of the same cylinder and are strongly threaded as indicated at 48.

A large diameter, strong nut 50 is threaded onto the threads 48 of shank 41. It has radial handles H to facilitate turning. Nut 50 is not only associated with threads 48 but with a combination pivot and adjustment mechanism 51 described in detail below. The relationships are such that rotation of the nut 50 causes the jaws to open or close to the desired position relative to a particular diameter of tool joint. Furthermore, the mechanism 51 is such that the hook 37 pivots about a predetermined vertical axis relative to head 36.

The indicated pivoting of hook 37 relative to head 36 is effected in two ways. Initially, the pivoting is effected by a bite cylinder 52, which is first operated to close the hook 37 on the tool joint so that teeth portions of dies (described below) bite initially on the tool joint. Thereafter, when the head 36 is turned clockwise, due to the connection of struts 46 to frame component 10*a* as subsequently described, the hook 37 closes further on the tool joint to powerfully grip it for effective making of the tool joint.

As shown in FIG. 3, the base end of the body of bite cylinder 52 is connected to a bracket 52*b* on a strut 46. The piston rod of cylinder 52 (FIGS. 3 and 8) is connected to a U-shaped element 53 the ends of which extend slidably into top and bottom elongate grooves 54 in hook 37. Such grooves 54 are substantially parallel to the shank 41 of such hook. Cylinder 52 and grooves 54 are so oriented as to permit the bite cylinder to effectively pivot hook 37 to desired open or closed positions, without causing binding.

The hook end 47 of hook 37 extends away from frame portion 10*a*, generally parallel to the struts 46. The space between the extreme end of hook end 47 and the opposed region of head 36 is open, so that the jaw set 21

(and 23) may be readily positioned around the tool joint when the entire apparatus is moved toward the tool joint as described subsequently.

Figure 10:
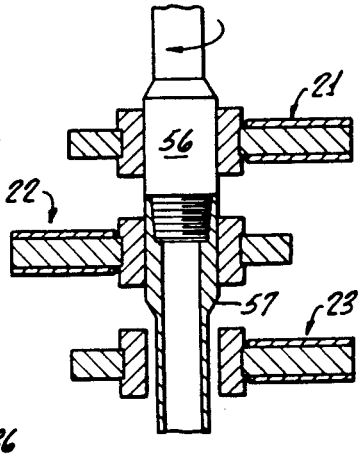
FIG. 10 is a schematic view illustrating the conditions of the jaws during making of a joint, the top and middle levels of jaws being closed.
Figure 11:
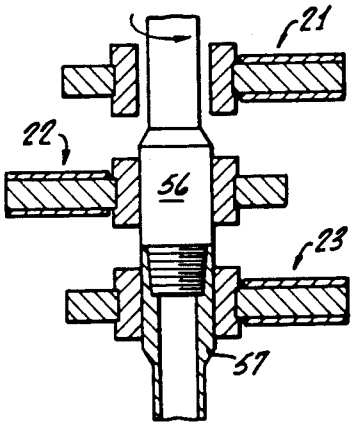
FIG. 11 is a schematic view showing the conditions of the jaws during breaking of a tool joint, the middle and bottom levels of jaws being closed.

A typical tool joint is shown schematically in FIGS. 10 and 11, the joint having an upper component 56 threadedly connected to a lower component 57. In a conventional drill pipe string, the upper component is turned clockwise during making of the joint.

As shown in FIGS. 10 and 11, the upper and lower jaw sets 21, 23 are alternately closed for actual torquing of the joint The middle jaw set 22, on the other hand, is always closed for such torquing.

Proceeding next to the middle set 22 of jaws, and referring particularly to FIG. 3, this is identically constructed to the upper and lower jaw sets 21, 23 except as specifically described.

Like the upper and lower sets 21, 23, the middle set 22 opens away from the frame portion 10*a*, so that all three jaw sets 21–23 are simultaneously mounted on the tool joint 56, 57 when the apparatus is moved toward such joint. Very importantly, however, the middle set 22 of jaws is reverse-oriented relative to the top and bottom sets 21, 23. Thus, the hook end of jaw set 22 extends in a direction diametrically opposite that of the hook ends of jaw set 21, 23. Accordingly, as previously stated, the middle jaw set further energizes and rotates a tool joint component when the middle set is rotated counterclockwise.

The components of the middle set 22, except those additional components specifically described, are given the same reference numeral as are the components of upper and lower sets 21, 23, except followed in each instance by the letter "a".

As previously indicated, the middle jaw set is not connected directly to frame portion 10*a* but instead is pivotally connected by pivot means 28 to the end of the piston rod 29 (FIGS. 4 and 5) of torquing cylinder 24. Stated more specifically, the struts 46*a* that support head 36*a* connect to a vertical plate 60 that, in turn, is fixedly connected to a second vertical plate 61 to which are secured upper and lower horizontal plates 62, 63. Extended between horizontal plates 62, 63 is a cylinder 64, such cylinder and the plates 62, 63 being part of the pivot means 28 that effect the strong pivotal connection between the piston rod of cylinder 24 and the middle jaw set 22.

General Description of the Method Relative to the Apparatus Portions Thus Far Described Stated generally, the method comprises disposing three vertically-spaced jaw sets, mounted on a common frame, at the wellhead of a well and adjacent a pipe string having threaded joints. The nuts 50 and 50*a* are rotated to adjust the jaw openings to the proper size for the particular pipe being operated upon.

To form a joint, the top pipe section is rotated (spun up), as by a spinning tool, until only final tightening is required. Then, the present apparatus is adjusted to such a vertical position that the top jaw set 21 is adjacent the upper component 56 of the tool joint (FIG. 10). The middle jaw set 22 is—because of the amount of spacing between the vertically-spaced wrenches—then adjacent the lower component 57 of the tool joint. The lower jaw set 23 is then normally below the tool joint, being then adjacent the pipe itself.

The upper and middle jaw sets 21, 22 are then closed on the pipe, following which the upper jaw set is rotated to make the joint. Thereafter, the upper and middle jaw sets are opened so as to release the thus made joint.

To break (or loosen) a joint prior to unthreading thereof (as by spinning out by use of a conventional spinning tool), the apparatus is moved vertically to the position of FIG. 11. Middle jaw set 22 is then adjacent the upper component 56 of the joint; lower jaw set 23 is adjacent the lower joint component 57; and upper jaw set 21 usually is above the joint.

The middle and lower jaw sets 22, 23 are then closed as shown in FIG. 11. The middle jaw set 22 is then rotated counterclockwise to break or loosen the joint.

The method comprises providing the upper, middle and lower jaw sets in vertically spaced relationship and connected together in a self-contained tool. The upper and lower jaw sets 21, 23 are fixed to a common frame.

The middle jaw set 22 is not fixed to the frame but instead pivotally associated therewith, the relationships being such that the middle jaw set may pivot horizontally relative to the frame and, at other times, the frame may pivot horizontally relative to the middle jaw set. In the preferred form, such relative pivoting is effected by a torquing cylinder connected between the frame and the middle jaw set.

To make a joint, after spinning up of the upper pipe section, the tool is caused to be at the vertical and horizontal positions, shown in FIG. 10. Furthermore, the tool is suspended at the wellhead, as from the rig hook shown in FIG. 2.

The upper and middle jaw sets 21 and 22 are then closed. Because jaw set 22 is closed on the lower joint component 57, they cannot move in that the pipe string already in the well tends strongly to prevent such movement. Thus, when the torquing cylinder 24 is operated, the middle jaw set 22 remains stationary and the entire remainder of the tool rotates about a vertical axis. The direction of rotation is caused to be such as to make the joint between tool joint sections 56, 57. Jaws 21, 22 are then opened, and the tool resumes its original position.

It is to be noted that the entire tool can thus be rotated because it is suspended in a relatively freely rotatable manner, at least through the small angle required for making of the joint.

To break the joint, the tool is positioned in the orientation shown in FIG. 11, and middle and bottom jaw sets 22, 23 are closed. Because bottom jaw set 23 is fixedly associated with the frame of the tool, operation of the torquing cylinder does not rotate the tool but instead rotates only the upper tool joint component 56. The direction of rotation is such as to break the joint. Jaw sets 22, 23 are then opened.

Stated more definitely, the jaw sets are caused to be of a type which energize in response to rotation in a particular direction. Upper and lower jaw sets 23 are oriented in the same way, while middle jaw set 22 is reverse-oriented Stated more definitely, the upper and lower jaw sets are so oriented as to tend to rotate the pipe clockwise while the middle jaw set 22 is oriented to rotate the pipe counterclockwise.

Making of a joint is indicated in FIG. 4, in which the parts are shown with the jaws closed on the tool joint. The before-making position is shown in solid lines, the torquing cylinder 24 being in its retracted condition. To make the joint, torquing cylinder 24 is operated to the extended position shown in phantom line in FIG. 4. Because the middle jaw set 22 is locked to the lower joint component 57, such extension causes the entire tool to rotate clockwise and, therefore, the upper jaw set rotates with it to make the joint. The jaws are then opened.

It is to be noted that the lower jaw set 23 does not interfere with rotation of the tool, because it is at all times open, during the making operation, as shown in FIG. 10.

Breaking of a joint is shown in FIG. 5, which is to be considered in conjunction with FIG. 11. The tool is raised to the FIG. 11 position, and the middle and lower jaw sets 22, 23 are closed, respectively, on the upper and lower tool joint sections 56, 57. (Jaw set 21 is not closed.) This is done while the torquing cylinder 24 is in its retracted condition shown in solid lines in FIG. 5.

Then, the torquing cylinder is again extended, to the phantom line position, as it was during the making operation described relative to FIG. 4, but this time the tool does not rotate. Instead, the tool is locked on the stationary lower joint component 57 by jaw set 23. Only the middle jaw set 22 rotates. The cylinder extension causes counterclockwise rotation of the middle jaw set 22, thus breaking the tool joint. The jaws are then opened.

One aspect of the method comprises initially closing the single-direction jaws by bite cylinders such as cylinders 52 and 52*a*. Such cylinders achieve the initial gripping, when combined with die means set forth below, while the hook-and-head combination of the jaws achieves final gripping in response to rotation or attempted rotation of a pipe section. Each of the preferred jaw sets will operate in only a single direction relative to the pipe, in the preferred embodiment.

In the preferred embodiment of the method, the operation of the single torquing cylinder in the same direction causes making of a joint when a joint is being made, and causes breaking of a joint when a joint is being broken. In the preferred form, this single direction is the one which causes the cylinder to extend.

Description of Die and Cam Means

Referring to FIGS. 6–9, inclusive, there are shown die and cam means adapted (1) to effectively grip tool joint after tool joint without damaging it, (2) to be usable with different diameters of tool joints within a predetermined wide range, and (3) to open and close automatically as the apparatus is moved off and on a string of pipe.

The cam and die elements on opposite sides of the tool joint are mirror images of each other; therefore, they are given the same reference numerals.

Figure 7:
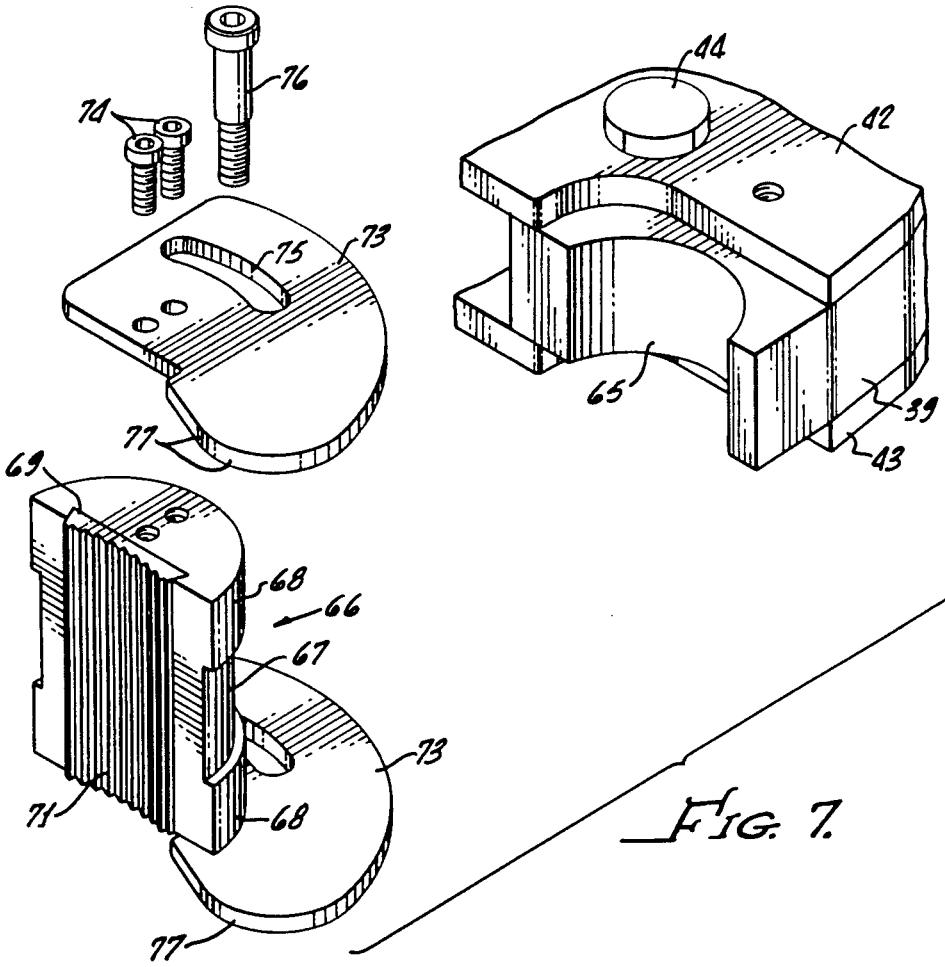
FIG. 7 is an exploded isometric view of one die and cam combination.
Figure 9:
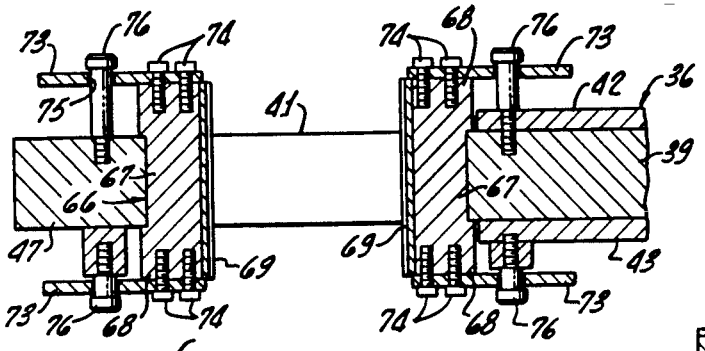
FIG. 9 is vertical sectional view on line 9—9 of FIG. 8.

The strong element 39 of head 36, and the hook end 47 of hook 37, are provided with opposed recesses the walls 65 of which are generally semicylindrical (FIG. 7). Each such recess rotatably receives a die segment 66 that is also generally semicylindrical. As shown in FIGS. 7 and 9, each die segment 66 has a central portion 67 the diameter and height of which correspond to that of the wall 65 into which the die segment fits. Furthermore, each die segment has upper and lower flange portions 68 that fit above and below the element 39 or the hook end 47. The head plates 42, 43 are cut back to prevent interference with flange portions 68.

Removably mounted in each die segment 66 is a die insert 69 having a multiplicity of elongate vertical teeth 71 (FIG. 7). Each die insert 69 is held in its associated die segment 66 in dovetail relationship, and is prevented from moving vertically by edge portions of cam plates described below.

In the preferred form, the crests of the teeth of each die do not lie in a plane but instead lie along the surface of a vertically-disposed imaginary cylinder. Such imaginary cylinder has a diameter somewhat larger than that of the largest diameter of tool joint relative to which the present apparatus is adapted to operate. Where (for example) the largest diameter of tool joint is 7 inches, the imaginary cylinder has a diameter of $7\frac{3}{8}$ inches. Horizontal cam plates 73 are mounted above and below each die segment 66, as by screws 74. Each cam plate has an arcuate slot 75 therein, the slot having the same center (vertical axis) as that of the associated semicylindrical wall 65. A screw 76 extends through each slot 75 and is threaded into the associated plate 42, 43 (and element 39) or hook end 47. The slot walls cooperate with the screws 76 in maintaining die segments 66 seated rotatably in their associated recesses, with the generally semicylindrical walls 65 adjacent the corresponding walls of central portions 67.

Figure 6:
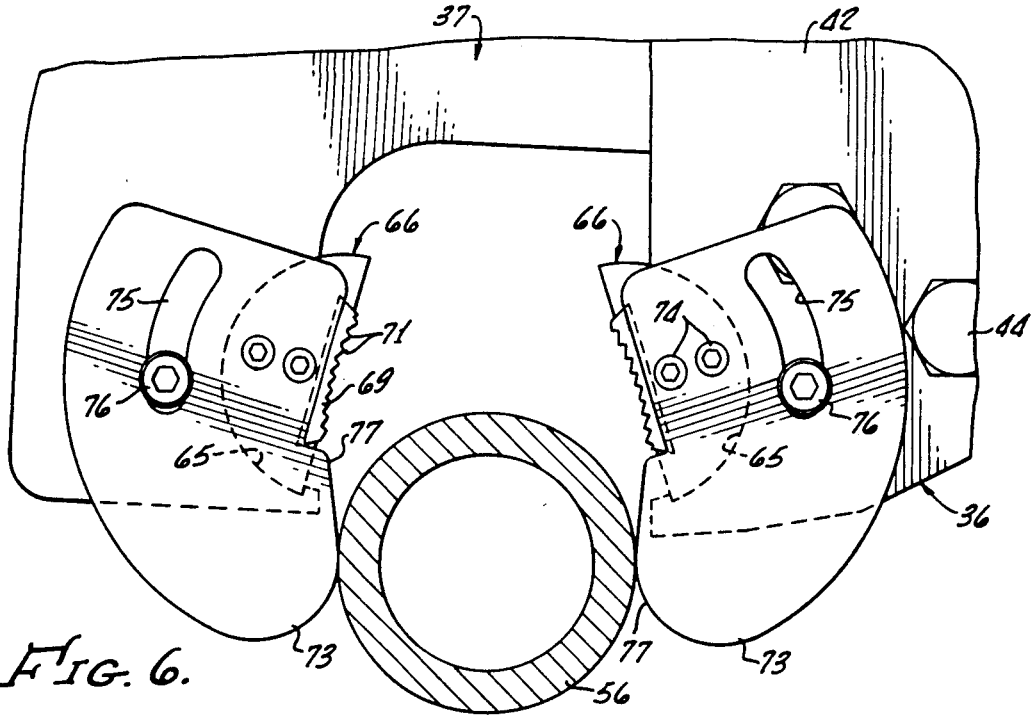
FIG. 6 is a fragmentary top plan view of one set of die and cam combinations, as related to a portion of a tool joint, the jaws being shown in open condition.

The cam plates 73 have edge portions 77 that cooperate with the tool joint 56 (and 57) in cam and cam-follower relationship. Thus, as shown in FIGS. 6 and 7, edge portions 77 are relatively straight adjacent the outer regions of die inserts 69, and incline forwardly (outwardly) from the regions of the forwardmost teeth 71. At regions relatively remote from the die inserts, the edges 77 are rounded to facilitate mounting of the present tool onto a drill string.

FIG. 6 shows the cam and die apparatus in the positions assumed when the tool is being moved off a pipe string. This occurs when the various bite cylinders 52 are in their retracted conditions, the jaws being open.

FIG. 8 shows the positions of the parts after tool joint 56, 57 is centered—by stop means described below—between the die segments 66, and after the cylinders 52 have been operated to extended condition to initially close the jaws.

The parts are so constructed, and the nuts 50 so set, that when the jaws are thus initially closed as shown in FIG. 8, the central portions of the die inserts 69 are in engagement with substantially diametrically opposite regions of tool joint 56, 57. The die inserts automatically center on the pipe.

After the joint has been made or broken, the cylinders 52 are operated to their retracted conditions so as to open the jaws. The present apparatus is then moved off of the tool joint 56, 57, the parts then coming into the position of FIG. 6 before the apparatus is completely away from the tool joint.

As the apparatus moves from the FIG. 8 position to the FIG. 6 position, the die segments 66 are caused to pivot in opposite directions such that the inner regions thereof (those regions relatively adjacent shank 41 of the hook) are relatively close together as shown in FIG. 6. Stated otherwise, the left die segment 66 shown in FIG. 6 pivots clockwise while the apparatus is moved off the tool joint, while the right die segment shown therein then moves counterclockwise. The inner die portions (those nearest shank 41) are then relatively close to each other, in position to engage and be moved apart by a tool joint 56, 57 when the apparatus is again mounted onto a tool joint.

When another joint is to be made or broken, the apparatus is moved onto such other joint, which usually initially comes into contact with one or the other of the vertically-aligned sets of cam plates 73, at rounded regions thereof. The present apparatus is then moved further toward the tool joint, until the tool joint seats on the stop means described below. Then, the bite cylinders 52 are extended to cause initial biting of the teeth 71 into the tool joint surface. The dies automatically center as above stated.

When the tool joint is one that is relatively small in diameter, only relatively central ones of the teeth 71 engage and bite the tool joint surfaces. This is satisfactory because less torque is required to break or make a relatively small-diameter tool joint than is required to make or break a relatively large-diameter tool joint. When the tool joint is relatively large in diameter, so that all or substantially all of the teeth 71 engage and bite into the tool joint surfaces, more teeth are engaged with the tool joint to transmit the additional torque needed for relatively large-diameter tool joints.

As above stated, the diameter of the imaginary cylinder containing the crests of teeth 71 is caused to be somewhat larger than the diameter of the largest-diameter tool joint to be made or broken by the present apparatus. This is in order that there will be an initial stress concentration at those teeth which initially engage the tool joint, when the bite cylinders are extended, causing such teeth to bite into the tool joint with high stress concentration and thus prevent slippage. As the pressure increases, as the result of torquing and consequent pivoting of the hooks, the teeth bite in more and more but not so much as to damage the tool joint.

When the apparatus is moved onto a tool joint, the tool joint initially engages the inner regions of the die segments, those nearest shank 41, which are then in the general pivoted position of FIG. 6. Such engagement causes the inner regions of the die segments to pivot in opposite directions (counterclockwise relative to the left segment in FIG. 6, clockwise relative to the right segment therein) before the below-described stop means is engaged.

The diameters and centers of the die segments 66 are such that torquing of the jaw sets causes increased energization thereof for more firm biting of the teeth 71 into the tool joint surfaces, but without crushing or damaging the tool joints. The center of the generally semicylindrioal surface of the central portion 67 of each die segment 66 is located somewhat into the wall of the tool joint 56, 57. For example, and referring to FIG. 8, the center of the central portion 67 shown at the right is caused to be slightly to the left of teeth 71 of such right die segment 66. Similarly, the center of the left die segment 66 (FIG. 8) is caused to be somewhat to the right of the teeth of such left die segment. This relationship causes the dies to self energize, to bite into the tool joint during torquing, instead of rolling off the tool joint.

Apparatus and Method for Positioning Different Diameters of Tool Joints in Proper Relationship to the Dies, and for Positioning the Middle Jaw Set 22 in Proper Rotated Position Prior to Commencement of a Make or Break Operation Referring to FIGS. 3 and 5, two generally L-shaped cranks 78 are provided, the illustrated cranks being above and below the middle jaw set 22. Cranks 78 are connected, at corresponding positions, to upper and lower ends of a vertical shaft 79. Such shaft is pivotally mounted at its ends on ears 81 that are secured to the frame 10 of the apparatus.

An actuation crank 82 is also connected to the shaft 79, the outer end of such crank 82 being pivotally associated with a linkage 83 and thus with a nut 84. Nut 84 receives a threaded shaft 86 on the outer end of which is mounted a knob or handle 87.

The nut 84 is welded to a bracket 88 secured to frame 10. Shaft 86 does not connect to such bracket 88 except at the nut 84. The end of shaft 86 is rotatably associated (but without permitting relative axial movement) with a bracket 89 that is pivotally connected to the linkage 83.

With the described construction, rotation of handle 87 causes pivoting of shaft 79 and thus adjusts forwardly or rearwardly the end faces 91 of cranks 78. These end faces 91 act as stops that engage the tool joint 56, 57. For any size of tool joint in the operating range for the particular tool (for example, a range of 3.5 inch 0.D. to 7 inch 0.D.), the handle 87 is turned to such position that end faces 91 will cause the tool joint to be centered in the jaws 21–23.

To adjust the apparatus for different diameters of tool joints, the handle 87 is turned as described. Furthermore, the various nuts 50 are turned to open or close each set of jaws 21–23, as described subsequently, to accommodate the different joint diameters.

There will next be described the means and method for causing the middle jaw set 22 to be in the desired position prior to the beginning of each make or break operation. The means for accomplishing this result are correlated to the adjustable stop means described above.

There is provided on the shaft 79 a third crank, numbered 92, that is pivotally connected through a link 93 to a pivotal stop 94. The stop 94 is pivotally connected, at 96, to a bracket 97 on frame 10 (FIG. 5). The link 93 is adjustable in length, being formed of two components that overlap each other and are secured together by bolts 98 extending through a longitudinal slot 99 (FIG. 5).

A vertical pin 101 is secured firmly to the upper head plate **42*a* of middle jaw set 22. Pin 101 extends upwardly to the elevation of pivotal stop 94, the latter being a horizontal plate having a relatively sharply concave edge 102 (FIG. 5) on the side thereof relatively adjacent the pin 101. A helical tension spring 103 is connected between the middle jaw set 22 and the frame 10, such spring being directed to bias the middle jaw set to a position at which pin 101 engages the concave edge 102 of stop 94. Stated more specifically, spring 103 is connected to the outer end of the body of cylinder 52*a* of the middle jaw set, as shown in FIG. 3**.

During the above-described portion of the method by which a tool joint is made, the middle jaw set 22 is locked in position and the frame 10 is moved clockwise. When the frame thus moves clockwise, the stop 94 pivots away from the then-stationary pin 101. Conversely, when a joint is broken, the frame is held stationary by the lower jaw set 23 while the middle jaw set 22 is pivoted counterclockwise, so that the pin 101 moves away from the then-stationary stop 94. In either case, the spring 103 is stretched and subsequently pivots the middle jaw set 22 relative to the frame until the pin 101 comes to a soft landing on the curved edge 102 of stop 94.

The landing is "soft" because the helical tension spring operates while the torquing cylinder 24 is being retracted hydraulically, it (and all cylinders described herein) being double-acting. Such retracting causes the parts to shift from the phantom-line positions in FIGS. 4 and 5 to the solid-line positions therein. Retraction of cylinder 24 is effected, in each instance, after the joint has been made or broken, and after the bite cylinders 52 have been retracted to their jaw-open positions. The stop 94 is adjusted conjointly with adjustment of end faces 91 as described above, by turning the handle 87 to rotate shaft 79. The various cranks and links are proportioned and adjusted, (it being remembered that the link 93 is adjustable in length by first loosening and then tightening the bolts 98 (FIG. 5), in such manner that the middle jaw set 22 will be in the correct pivoted position relative to the upper and lower jaw sets 21 and 23 for each diameter of tool joint.

Thus, to change the apparatus for operation on a different diameter tool joint than that relative to which previous operations had been occurring, the handle 87 is turned in order to shift stop 94 in the appropriate direction for the different joint diameter Furthermore, the three nuts 50 and 50*a* are turned on their threaded shanks 41 to open or close the jaw sets to the proper setting for the new diameter of tool joint. Marks may be provided on the shanks 41 and on the stop 94 to aid in these adjustment operations.

The heads 36 of top and bottom jaw sets 21, 23 are fixed in position, in vertical alignment. Thus, the hook 37*a* of the middle jaw set 22 is caused, at its teeth, to be directly between and in line with the teeth of the top and bottom heads 36. It is the head 36*a*, of the middle jaw set 22, that is adjusted in position so as to accommodate different joint diameters. Stated otherwise, once the jaw openings are correct for the particular joint diameter, as determined by nuts 50 and 50*a*, the described stop and pin mechanism 94, 101, etc., is so set that when the pin 101 engages the stop 94, the teeth of the head 36*a* of the middle jaw set are directly in line with the teeth of the top and bottom hooks 37.

Description of the Pivot and Adjustment Means and Method for Associating Nuts 50 With Hook Shanks 41 and Heads 36 in Precision Manner Again, the pivot and adjustment portion of only the upper jaw set 21 will be described, it being understood that the lower jaw set 23 has the same elements identically numbered. Also, the middle jaw set 22 has the same elements, also identically numbered except that the letter "a" follows each numeral.

Figure 12:
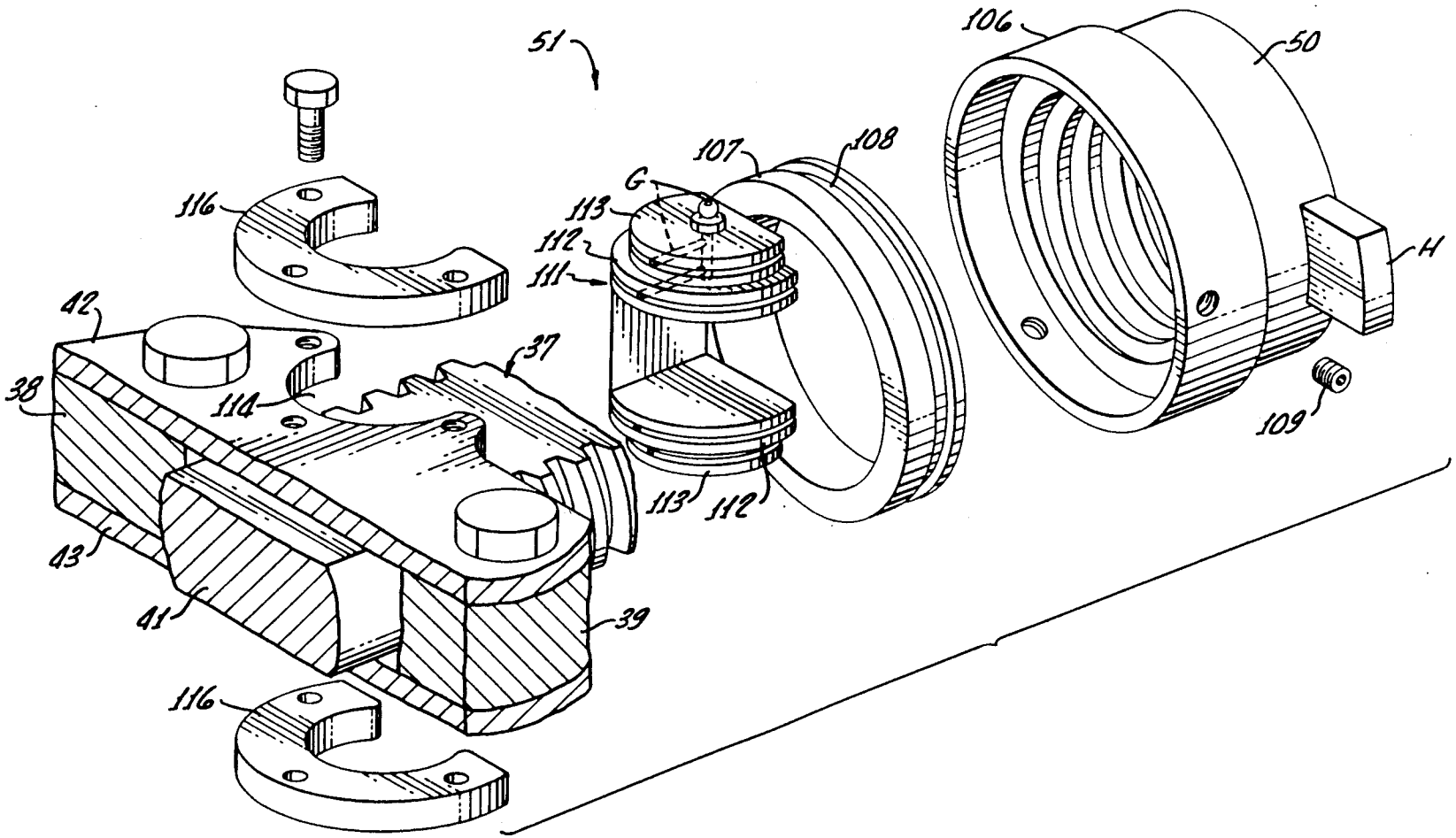
FIG. 12 is an exploded view showing isometrically the high-strength bearing, pivot and adjustment mechanism for each jaw.

Referring to FIGS. 8 and 12, nut 50 has a strong collar 106 partially telescoped thereover and welded fixedly thereto, at the nut end relatively adjacent head 36. A bearing ring 107 is strongly pivotally connected to head 36. Such bearing ring has an outer diameter corresponding to that of nut 50; the outer cylindrical surface of bearing ring 107 fits slidably within collar 106 as shown in FIG. 8.

The bearing ring 107 has an annular groove 108 formed externally thereof. The annular groove 108 is disposed radially-inwardly of, and receives, pins 109 that extend radially-inwardly through the protruding end of collar 106. The pins are circumferentially spaced about collar 106, and their inner ends prevent the combination nut 50 and collar 106 from moving axially relative to bearing ring 107. On the other hand, rotation of the combination nut 50 and collar 106 causes the shank 41 and thus all of hook 37 to move axially relative to the head 36, the direction of movement depending upon the direction of rotation of the nut and collar.

Bearing ring 107 is strongly welded to a cylinder 111 that is rotatably mounted in vertical relationship in the top and bottom plates 42, 43 of head 36. Cylinder 111 has a relatively large-diameter main body 112 coaxially rigidly associated with upper and lower necks 113.

Body 112 of cylinder 111 is sufficiently long to extend between the outer surfaces of head plates 42 and 43. It does so through semicylindrical-walled openings 114 formed in such head plates at the edges thereof adjacent nut 50, and between the strong elements 38, 39 (FIG. 8).

To maintain the cylinder 111 in semicylindrical-walled openings 114, upper and lower C-rings 116 are secured by screws to the upper and lower head plates. Each C-ring has an inner diameter only slightly larger than that of the necks 113 of cylinder 111. Since the C-rings extend for more than 180 degrees, they prevent the cylinder 111 from moving away from the head plates. At the same time, the C-rings prevent upward and downward movement of the cylinder 111.

The bearing ring 107, which is also an adjustment ring in that it cooperates in determining the shank positions of the hook element, is spaced sufficiently far from the head plates 42, 43 and other head elements that bearing ring 107 may pivot about a vertical axis through a predetermined angle. This predetermined angle is sufficiently large to accommodate any angular position that shank 41 is pivoted to due to operation of bite cylinders 52 and/or due to operation of torquing cylinder 24.

The openings 114 and the cylinder 111 are not centered relative to bearing ring 107 but instead are located to one side thereof, as shown in FIGS. 8 and 12, such side being the one on the opposite side of shank 41 from hook end 47. Furthermore, the main body 112 of cylinder 111 is carved out at one side so that, as viewed in FIG. 12, the cylinder body 112 appears generally U-shaped. The side positioning, and the carving out are such that the shank 41 of hook 37 may be and is extended through and adjacent cylinder body 112, and between the strong elements 38 and 39.

Furthermore, the nut 50 is threaded onto the threads 48 of shank 41, and the bearing ring 107 fits closely around the threads 48 thereof. Accordingly, the described apparatus causes there to be, for any adjusted position of shank 41 relative to the head 36, a precisely-located vertical pivot axis for hook 37. Such precise pivot axis is at the center of cylinder 111.

The cylinder 111 has grease fittings and passages G at its upper and lower portions, as shown in FIG. 12. The passages communicate with external grease grooves.

The described mechanism, accordingly, not only causes the hook 21 to move inwardly and outwardly to various precise desired settings, but causes such mechanism to pivot about a precise vertical axis for any hook setting. Accordingly, and because of the above-described die elements 66 and other elements, the present jaw apparatus will operate effectively on tool joint after tool joint, with little or no problem of slipping In addition, the described apparatus provides a very strong bearing relationship by which the strong powerful forces present in the hook 37 are effectively transmitted to the head plates 42, 43 in large-area bearing relationship, for maximized strength and wear resistance.

BRIEF SUMMARY OF METHOD

The tool is adjusted for the particular diameter of tool joint, as described above, and is mounted on the tool joint as described above.

To make a joint, jaw sets 21, 22 and 23 are put in the positions shown in FIG. 10. Upper and middle bite cylinders 52, 52*a* are operated to extend themselves and thus close jaw sets 21 and 22, so that they bite on the upper and lower tool joint components 56, 57. Then (FIG. 4), torquing cylinder 24 is extended to rotate the entire tool except for jaw set 22. The jaw sets energize, as described.

As the joint becomes tighter and tighter, the hydraulic pressure in torquing cylinder 24 builds up to a pre-set point that is adapted to achieve the correct predetermined desired degree of "make" torque on the joint. Then, a bypass valve opens that bleeds the pressure from torquing cylinder 24. The jaw sets 21, 22 accordingly deenergize. Then, the bite cylinders 52, 52 of the upper and middle jaw sets are operated to retract themselves and thus open the jaws. Then, torquing cylinder 24 is operated to retract itself until it bottoms out. The middle jaw set is simultaneously pivoted to its original position by spring 103. The retracting cylinder 24 is caused to bottom out just before pin 101 hits stop 94, so that final pivoting of jaw set 22 is caused solely by spring 103, such final movement continuing until elements 101 and 94 engage with each other.

To break a joint, the parts are moved to the FIG. 11 positions as described above. Bite cylinder 52*a*, 52 of middle and bottom jaw sets 22, 23 are operated to extend themselves and cause biting onto joint components 56, 57. Torquing cylinder 24 is operated in the same direction as before—in a direction to extend itself (FIG. 5) and pivot jaw set 22 while the rest of the tool is stationary. The jaw sets 22, 23 energize. The hydraulic pressure delivered to cylinder 54 is caused to be sufficient to break the tool joint. The cylinder 24 is extended until it substantially bottoms out. Then, cylinder 24 is bled of pressure, so that jaw sets 22, 23 deenergize. The bite cylinders 52*a*, 52 of the middle and lower jaw sets are operated to retract themselves and open the jaws.

Then, cylinder 24 is operated to retract itself, and this in combination with spring 103 move the middle jaw set back to start position Again, the spring by itself performs the last part of this motion, until pin 101 and stop 94 engage.

In the appended claims, the "first string" and "second string" may be the same string—at one time being connected and at another time disconnected.

The foregoing detailed description is to be clearly understood as given by way of illustration and example only, the spirit and scope of this invention being limited solely by the appended claims.

I claim:

1. A method of making and breaking joints in strings of threadedly-interconnected pipe, which comprises:

(a) providing three power jaw sets on a common frame, each jaw set being adapted to grip a portion of a string of pipe, (b) disposing said jaw sets adjacent a first pipe string of threadedly-interconnected pipe, with two of said jaw sets adjacent one pipe section thereof, and one other of said jaw sets adjacent the next pipe section thereof, said one pipe section and said next pipe section being connected to each other by a threaded joint, (c) gripping at least one of said two jaw sets onto said one pipe section, and gripping said one other jaw set onto said next pipe section, (d) causing said one jaw set and said one other jaw set to apply torque at said threaded joint, said torque being so directed and sufficient to achieve relative rotation between said pipe sections in a direction to make a joint between said pipe sections, (e) releasing said jaw sets from said pipe sections, (f) disposing said jaw sets adjacent a second pipe string of threadedly-interconnected pipe, with one of said jaw sets adjacent one pipe section of said second string, and two other of said jaw sets adjacent the next pipe section of said second string, said one and said next pipe sections of said second string being connected to each other by a threaded joint, said two other of said jaw sets recited in this clause including said one of said two jaw sets recited above in a preceding clause relative to said one pipe section of said first string, (g) gripping at least one of said two other jaw sets that are adjacent said next pipe section of said second string onto such next pipe section thereof, and gripping said one jaw set that is adjacent said one pipe section of said second string onto such one pipe section thereof, and (h) causing the thus-gripping jaw sets, recited in the immediately preceding clause, to apply torque at said threaded joint of said second string, said last-stated torque being so directed and sufficient to achieve relative rotation between said pipe sections of said second string in a direction to break a joint between the same.

2. A method of making and breaking joints in strings of threadedly-interconnected pipe, which comprises:

(a) providing first, second and third power jaw sets on a common frame, (b) employing said first and second jaw sets to make joints in a string of threadedly interconnected pipe, and (c) employing said second and third jaw sets to break joints in a st ring of threadedly-interconnected pipe, said method being performed without turning said jaw sets over, said making and breaking being effected by employing power means to apply forces between said frame and at least one of said jaw sets.

3. A method of making and breaking threaded joints in strings of threadedly-connected pipe, said strings extending into an oil well, said method comprising:

(a) providing three jaw sets on a common frame, at least one of said jaw sets being fixed on said frame, at least one other of said jaw sets being mounted on said frame for pivotal movement relative thereto, (b) disposing said frame and jaw sets at the wellhead of an oil well containing a string of threadedly-connected pipe sections, (c) closing said one other jaw set on said string at a region beneath a joint thereof, so that said one other jaw set tends to be held against rotation by said string, (d) closing said one jaw set on said string at a region above said joint thereof, (e) effecting relative pivotal movement between said one other jaw set and said frame, thus causing said frame to pivot and accordingly causing said one jaw set to pivot, whereby to make or break said joint, and (f) opening said one jaw set and said one other jaw set.

4. The method as claimed in claim 3, in which the remaining one of said jaw sets is also fixed to said frame, in which said method further comprises disposing said frame and jaw sets at the wellhead of an oil well containing a second string of threadedly-connected pipe sections, closing said one other jaw set on said second string at a region above a joint thereof, closing said remaining one of said jaw sets on said second string at a region below said joint thereof, and effecting relative pivotal movement between said one other jaw set and said frame whereby to make or break said joint of said second string.

5. The method as claimed in claim 4, in which said method further comprises employing a fluid cylinder to effect both of said relative pivotal movements between said one other jaw set and said frame, and further comprises operating said fluid cylinder in a single direction to effect both of said relative pivotal movements.

6. The method as claimed in claim 3, in which said method further comprises causing each of said jaw sets to be unidirectional, so that it will only strongly torque a pipe section in one direction and not the opposite direction, and further comprises orienting said three jaw sets so that one thereof will strongly torque a pipe section in one direction, and two thereof will strongly torque a pipe section in a direction opposite to said one direction.

7. The method as claimed in claim 3, in which method further comprises not turning any of said jaw sets over.

8. Apparatus for making and breaking threaded joints between pipe sections, which comprises:

(a) first, second and third power jaw sets each adapted to strongly torque a pipe section in only a single direction, and (b) means to interconnect said first, second and third jaw sets with each other, said means and said jaw sets being so oriented that:

(1) two of said jaw sets can apply strong torque to a threaded joint between a pair of threadedly-connected pipe sections, in a direction to make said joint, (2) two of said jaw sets can apply strong torque to said joint in a direction to break said joint, and (3) said second-mentioned two jaw sets includes the one of said jaw sets that was not included in said first-mentioned two jaw sets.

9. The invention as claimed in claim 8, in which said connector means includes a frame, and means to pivotally connect one of said jaw sets to said frame and in which a torquing fluid cylinder is connected between said frame and one of said jaw sets.

10. The invention as claimed in claim 8, in which said connector means includes a frame, means to fixedly connect two of said jaw sets to said frame, and means to pivotally connect one of said jaw sets to said frame.

11. The invention as claimed in claim 10, in which said pivotally-connected one jaw set is disposed between said fixedly-connected two jaw sets.

12. Power apparatus for applying high torque to threadedly-interconnected oil-well pipe sections, comprising:

(a) a first jaw set for gripping a pipe section and applying torquing force thereto in only a single direction, (b) a second jaw set for gripping a pipe section and applying torquing force thereto in only a single direction opposite to said first-mentioned single direction, said jaw sets being connected to each other, each of said jaw sets comprising a head, each of said jaw sets also comprising a hook element the elongate shank of which extends through said head, each of said jaw sets further comprising a nut threadedly mounted on said shank on the side of said head remote from the hook end of said hook element, each of said jaw sets further comprising means to pivotally associate said hook element with said head, said last-named means comprising high-strength means to pivotally connect said hook element and head for pivotal movement of said hook element about a predetermined axis, each of said jaw sets further comprising power means to effect pivotal movement of said hook element relative to said head, each of said jaw sets further comprising die means mounted on said hook end of said hook element, and on said head, to firmly grip pipe sections to be torqued for making or breaking of threaded joints therebetween, and (c) power means to effect relative pivotal movement between said first and second jaw sets to thereby torque pipe sections gripped between said hook ends and said heads.

13. The invention as claimed in claim 12, in which the means to connect said jaw sets to each other includes a frame, in which said first jaw set is fixedly mounted to said frame, and in which said second jaw set is pivotally mounted to said frame, said jaw sets being generally parallel to each other and being adapted to simultaneously grip two axially related pipe sections that are connected to each other by a threaded joint.

14. The invention as claimed in claim 12, in which means are provided to suspend said power apparatus at the wellhead of an oil well, said means including power means to adjust the elevation of said power apparatus.

15. The invention as claimed in claim 13, in which the means to mount said first jaw set to said frame comprises connector means extending transversely to said shank of said hook element of said first jaw set.

16. The invention as claimed in claim 15, in which said connector means is fixedly connected to said frame and to said head of said first jaw set.

17. The invention as claimed in claim 13, in which the means to mount said second jaw set to said frame comprises connector means extending transversely to said shank of said hook element of said second jaw set, said connector means being fixedly connected to said head of said second jaw set, and being pivotally connected to said frame.

18. The invention as claimed in claim 17, in which the pivotal connection between said connector means and said frame is through a torquing cylinder, said torquing cylinder being said means to effect relative pivotal movement between said first and second jaw sets.

19. Apparatus for applying power torque to make or break threaded joints between drill pipe sections, said apparatus comprising:

(a) first, second and third jaw sets each adapted to grip a section of drill pipe in a string of threadedly connected drill pipe sections, (b) power means to close each of said jaw sets, (c) means to interconnect said jaw sets with each other in such manner that one pair of said jaw sets may simultaneously grip two pipe sections on opposite sides of the threaded joint therebetween, and another pair of said jaw sets may, at another time, simultaneously grip two pipe sections on opposite sides of the threaded joint therebetween, at least said first jaw set being fixedly connected to said connector means, at least said second jaw set being pivotally connected to said connector means for pivotal movement in a plane transverse to a pipe section gripped by said first jaw set, and (d) power means to apply torque between at least said first and second jaw sets for making or breaking of the threaded joint therebetween.

20. The invention as claimed in claim 19, in which said power means is so connected that said torque is transmitted through said connector means.

21. The invention as claimed in claim 20, in which said connector means is a rigid frame, and in which said power means is a torquing cylinder connected between said connector means and said second jaw set.

22. The invention as claimed in claim 19, in which said connector means is a rigid frame.

23. The invention as claimed in claim 19, in which said third jaw set is fixedly connected to said connector means.

24. The invention as claimed in claim 19, each of said jaw sets comprising a hook element the elongate shank of which extends through said head, each of said jaw sets further comprising a nut threadedly mounted on said shank on the side of said head remote from the hook end of said hook element, each of said jaw sets further comprising means to pivotally associate said hook element with said head, each of said jaw sets further comprising power means to effect pivotal movement of said hook element relative to said head, each of said jaw sets further comprising die means mounted on said hook end of said hook element, and on said head, to firmly grip pipe sections to be torqued for making or breaking of threaded joints therebetween.

25. The invention as claimed in claim 23, in which said second jaw set is between said first and third jaw sets.

26. The invention as claimed in claim 25, in which said connector means is a rigid frame, and in which said power means to apply torque is cylinder means connected between said frame and said second jaw set.

27. The invention as claimed in claim 19, in which means are provided to adjust each of said jaw sets for different diameters of pipe, without the necessity of removing or replacing any elements during any adjustment, and in which stop means are provided to engage said pipe and thereby effect positioning of said pipe in said jaw sets, said stop means being adjustable for different diameters of pipe.

28. The invention as claimed in claim 24, in which each of said die means comprises a rotatable die block having die teeth thereon.

29. The invention as claimed in claim 19, in which means are provided to suspend said apparatus from a support cable at the wellhead of an oil well, in said manner that said connector means may pivot in a generally horizontal direction.

30. The invention as claimed in claim 23, in which said suspension means includes power means to raise and lower said apparatus relative to said wellhead, to thereby position said jaw sets relative to the joint between the connected pipe sections, so that at one time said first and second jaw sets are positioned to grip pipe sections on opposite sides of the joint between them, and at another time said second and third jaw sets are positioned to grip pipe sections on opposite sides of the joint between them.

31. Apparatus for making and breaking threaded joints in drill pipe strings and other pipe strings, said apparatus comprising:

(a) a frame, (b) first and second sets of jaws mounted, respectively, at upper and lower portions of said frame, said first and second jaw sets being fixedly associated with said frame, (c) a third jaw set mounted on said frame between said first and second jaw sets, said first, second and third jaw sets being adapted to grip a pipe string having a threaded joint therein, the connection between said third jaw set and said frame being such that said third jaw set may pivot in a plane transverse to said pipe string when said pipe string is gripped by one of said first and second jaw sets, and (d) means to effect pivotal movement of said third jaw set relative to said frame and to apply torque to a threaded joint in a pipe string held by said third jaw set and by one of said first and second jaw sets.

32. The invention as claimed in claim 31, in which said last-named means comprises a fluid cylinder connected between said frame and said third jaw set.

33. The invention as claimed in claim 32, in which the body of said fluid cylinder is pivotally connected to said frame, and in which the end of the piston of said fluid cylinder is pivotally connected to said third jaw set.

34. The invention as claimed in claim 31, in which means are provided to change said jaw sets to adapt them for gripping substantially different diameters of pipes, without removing or replacing any parts, and in which stop means are provided on said frame to engage the side of a pipe and thus position the apparatus relative to such pipe, said stop means being adjustable to accommodate different diameters of pipe.

35. The invention as claimed in claim 31, in which means are provided to pivot said third jaw set to a position at which the jaws thereof are substantially in line with the jaws of said first and second jaw sets, and in which stop means are provided to stop said pivotal movement of said third jaw set when said jaws thereof are in said in-line position.

36. The invention as claimed in claim 31, in which means are provided to change said jaw sets to adapt them for gripping substantially different diameters of pipes, in which stop means are provided on said frame to engage the side of a pipe and thus position the apparatus relative to such pipe, said stop means being adjustable for different diameters of pipe, in which means are provided to pivot said third jaw set to a position at which the jaws thereof are substantially in line with the jaws of said first and second jaw sets, and in which stop means are provided to stop said pivotal movement of said third jaw set when said jaws thereof are in said in-line position.

37. The invention as claimed in claim 31, in which each of said jaw sets comprises a hook element and a head element that are adjustable relative to each other and that are open in a direction toward a pipe string when said first, second and third jaw sets are substantially in line with each other, each of said jaw sets including dies respectively mounted on said hook elements and head elements for gripping said pipe string, each of said jaw sets incorporating adjustment means to change the sizes of the openings therein to accommodate different diameters of pipes.

38. The invention as claimed in claim 37, in which each of said jaw sets is adapted to apply strong torquing force to a pipe string in only a single direction, in which said first and second jaw sets are oriented to apply strong torquing force to said pipe string in one direction, and in which said third jaw set is oriented to apply strong torquing force to said pipe string in a direction opposite to said one direction.

39. The invention as claimed in claim 31, in which each of said first, second and third jaw sets comprises a head and a hook element, the shank of said hook element extending through said head, said shank being adapted to move axially and pivotally in said head, in which a nut is threaded onto said shank to determine the position of said hook element relative to its associated head and thus determine the size of the opening between the jaws, in which means are provided to fixedly connect said heads of said first and second jaw sets to said frame in such relationship that said first and second jaw sets are substantially in line with each other, and in which means are provided to pivotally connect said third jaw set to said frame in such position that the jaw opening of said third jaw set is substantially in line with the jaw openings of said first and second jaw sets when said third jaw set is in a predetermined pivoted position relative to said frame.

40. The invention as claimed in claim 39, in which fixed-position high-bearing pivot means are provided in said head of each of said first, second and third jaw sets, and in which means are provided to pivotally associate said nut of each jaw set with said pivot means whereby, for any adjusted position of the hook element of each of said jaw sets, there is a known axis of pivoting between said hook element and said head of each jaw set.

41. The invention as claimed in claim 39, in which a die block is pivotally mounted in the hook end of each of said hook elements in which another die block is pivotally mounted in the head portion opposite said first-mentioned die block, in which each of said die blocks has teeth adapted to bite into said pipe string when said jaw sets are closed, said die blocks of each jaw set being positioned to engage said pipe string at generally diametrically opposite portions of said pipe string, said die blocks having such diameters and such center positions as to bite into said pipe string in response to application of torquing forces to the heads of said jaw sets.

42. The invention as claimed in claim 41, in which power means are provided to pivot said hook elements to close said jaw sets prior to application of torquing force to said heads.

43. The invention as claimed in claim 41, in which each of said die blocks is generally semicylindrical and fits rotatably into a generally semicylindrical recess in said hook end of each of said hook elements.

44. The invention as claimed in claim 43, in which cam means are associated with said die blocks to automatically pivot said die blocks in response to moving of a pipe string section into or out of the space between the jaws of a jaw set.

45. The invention as claimed in claim 31, in which said means to effect pivotal movement of said third jaw set is a hydraulic cylinder, and in which slot walls are provided to engage said third jaw set and maintain it in a horizontal plane during pivoting.

46. A jaw set, which comprises:

(a) a head, (b) a hook element extended through said head in movable relationship, (c) a nut threadedly associated with the shank of said hook element on the side of said head remote from the hook end of said hook element, (d) toothed dies mounted on said hook end and on the side of said head opposite said hook end, said dies being adapted to grip a pipe section disposed therebetween, said dies being pivotally related to said hook end and to said head, and (e) cam elements connected to said dies, said cam elements being shaped to engage a pipe section and effect pivoting of said dies as said wrench is placed around said pipe section, said dies being adapted to be engaged by said pipe section to pivot said dies and said cam elements.

47. The invention as claimed in claim 46, in which each of said dies is generally semicylindrical, the cylindrical surface of each such die being rotatably mounted in a generally semicylindrical recess in the associated head or hook end, in which each of said dies has a substantially flat side facing the opposite die, said flat side having a substantial number of teeth therein, said teeth having crest portions lying generally on the surface of an imaginary cylinder, said imaginary cylinder having a diameter somewhat larger than that of the largest-diameter pipe with which the jaw set is to be associated.

48. The invention as claimed in claim 47, in which the center of each of said semicylindrical die segments is disposed outside of the teeth of such die segment but relatively close to such teeth, being within the wall of the pipe being operated upon by the jaw set.

49. A high-strength, accurate jaw set, comprising:

(a) a head, (b) a hook having a hook end and also having a shank that extends through said head, (c) a nut threadedly associated with said shank on the side of said head remote from said hook end, (d) means to strongly and accurately associate said hook with said head for pivotal movement of said hook relative to said head about a predetermined axis, said means comprising a relatively large diameter pivot cylinder journaled in said head, said means further comprising a bearing element fixedly connected to said cylinder for pivotal movement therewith, said bearing element being shaped and disposed to be engaged by the end of said nut that is relatively adjacent said head, said bearing element and said cylinder being adapted to permit passage of said shank therethrough, said bearing element and said nut being so associated that the pivot axis of said cylinder is that of said hook regardless of the rotated position of said nut and thus regardless of the axially-adjusted position of said shank, said bearing element being a ring having a diameter generally corresponding to that of said nut, said ring being adapted to be engaged by the end of said nut that is relatively adjacent said head, and (e) means to maintain the engaged ends of said nut and ring substantially concentric, said last-named means comprising a collar mounted around said nut on the end of said nut relatively adjacent said head, said collar extending toward said head from such nut end, said collar receiving said bearing ring therein.

50. The invention as claimed in claim 49, in which means are provided to fixedly secure said collar to said nut, and in which means are provided to maintain said collar continuously in the same axial position relative to said bearing ring.

51. The invention as claimed in claim 50, in which said last-named means comprises a plurality of set screws extended radially inwardly through said collar into an annular groove formed in the exterior of said bearing ring.

52. A high-strength, accurate jaw set, comprising:

(a) a head, (b) a hook having a hook end and also having a shank that extends through said head, (c) a nut threadedly associated with said shank on the side of said head remote from said hook end, (d) means to strongly and accurately associate said hook with said head for pivotal movement of said hook relative to said head about a predetermined axis, said means comprising a relatively large diameter pivot cylinder journaled in said head, said pivot cylinder being cut out so as to have a generally U-shaped portion, the opening in said U-shaped portion being adapted to receive said shank of said hook therein, said means further comprising a bearing element fixedly connected to said cylinder for pivotal movement therewith, said bearing element being shaped and disposed to be engaged by the end of said nut that is relatively adjacent said head, said bearing element and said cylinder being adapted to permit passage of said shank therethrough, said bearing element and said nut being so associated that the pivot axis of said cylinder is that of said hook regardless of the rotated position of said nut and thus regardless of the axially-adjusted position of said shank, (e) neck elements formed coaxially above and below said U-shaped portion, and (f) means provided around said neck elements and secured to said head to hold said neck elements and thus said cylinder in position.

53. A power jaw apparatus, which comprises:

(a) a head, (b) a hook element having a shank extended through said head, (c) a nut rotatably mounted on said shank on the side of said head remote from the hook end of said hook element, (d) pivot and bearing means to accurately and strongly associate said nut with said head for pivotal movement of said nut and thus said shank about a predetermined axis, regardless of the adjusted position of said shank in said nut, (e) a die segment rotatably mounted in said head on the side thereof remote from said nut, (f) a die segment rotatably mounted in said hook end of said hook element opposite said first-mentioned die segment, each of said die segments having teeth adapted to grip a pipe section, and (g) power means to pivot said hook element relative to said head to close said die segments on a pipe section.

54. The invention as claimed in claim 53, in which said die segments are so constructed as to increase the degree of gripping of said pipe by said die segments in response to rotation of said head about the center of a pipe gripped by said die segments, said rotation being only in a predetermined direction.

55. The invention as claimed in claim 54, in which cam means are associated with said die segments to pivot them as said jaw apparatus is mounted around the pipe section and removed therefrom, said cam elements being adapted to engage said pipe section during such entry and removal.

* * * * *